US010415280B2

(12) United States Patent
Freedman et al.

(10) Patent No.: US 10,415,280 B2
(45) Date of Patent: Sep. 17, 2019

(54) CONSTRUCTION FOR CHECK ARM KEEPER FOR CHECK ARM ASSEMBLY FOR VEHICLE DOOR

(71) Applicant: Warren Industries Ltd., Concord (CA)

(72) Inventors: David Freedman, Toronto (CA); John Moerman, Maple (CA); Sven Sauerwein, Newmarket (CA)

(73) Assignee: Warren Industries Ltd., Concord (CA)

( * ) Notice: Subject to any disclaimer, the term of this patent is extended or adjusted under 35 U.S.C. 154(b) by 164 days.

(21) Appl. No.: 15/401,946

(22) Filed: Jan. 9, 2017

(65) Prior Publication Data

US 2017/0114578 A1 Apr. 27, 2017

Related U.S. Application Data

(63) Continuation-in-part of application No. PCT/CA2015/050572, filed on Jun. 22, 2015.
(Continued)

(51) Int. Cl.
*E05C 17/20* (2006.01)
*E05D 11/06* (2006.01)
*E05D 11/10* (2006.01)

(52) U.S. Cl.
CPC ..... *E05C 17/203* (2013.01); *E05C 17/206* (2013.01); *E05D 11/06* (2013.01);
(Continued)

(58) Field of Classification Search
CPC ..... Y10T 16/304; Y10T 16/61; Y10T 16/625; Y10T 16/5385; Y10T 16/54028;
(Continued)

(56) References Cited

U.S. PATENT DOCUMENTS 5,173,991 A * 12/1992 Carswell ..... E05C 17/203 16/325
5,727,287 A * 3/1998 Hosken ..... E05C 17/203 16/334

(Continued)

FOREIGN PATENT DOCUMENTS

CN 1470726 A 1/2004
DE 20321505 U1 9/2007

(Continued)

OTHER PUBLICATIONS

Extended European Search Report for EP Application No. 15819517.2 dated Feb. 28, 2018.

*Primary Examiner* — William L Miller
(74) *Attorney, Agent, or Firm* — Millman IP Inc.

(57) ABSTRACT

In an aspect, a kit of parts is provided for a check arm keeper, which includes a keeper housing having a mounting bracket and a cartridge-mounting portion, and a plunger cartridge that includes a plunger cartridge housing mountable to the keeper housing, a plunger slidable in the plunger cartridge housing, and a plunger-biasing member positioned in the plunger cartridge housing to urge the plunger out from the plunger cartridge housing. The plunger has a first engagement member and the plunger cartridge housing has a second engagement member. The engagement members cooperate to retain the plunger in the plunger cartridge housing against a biasing force of the plunger-biasing member when the plunger cartridge is free from the keeper housing. Mounting of the plunger cartridge housing holds it in a selected position relative to the keeper housing and drives the plunger to a position in which the engagement members are spaced apart.

18 Claims, 13 Drawing Sheets

Related U.S. Application Data

(60) Provisional application No. 62/022,534, filed on Jul. 9, 2014.

(52) U.S. Cl.
CPC ..... *E05D 11/1085* (2013.01); *E05Y 2900/531* (2013.01); *Y10T 16/61* (2015.01)

(58) Field of Classification Search
CPC ..... Y10T 16/54044; E05C 17/203; E05C 17/206; E05D 11/06; E05D 11/1085; E05Y 2900/531; E05F 1/1238; E05F 3/20; E05F 5/06; E05F 5/025
USPC ..... 16/82, 50, 85, 321, 297, 334, 344; 296/146.11
See application file for complete search history.

(56) References Cited

U.S. PATENT DOCUMENTS

| | | | | |
|---|---|---|---|---|
| 6,446,305 | B1 * | 9/2002 | Kneeland | E05C 17/206 16/49 |
| 6,728,993 | B1 * | 5/2004 | Murayama | E05C 17/206 16/342 |
| 2003/0163895 | A1 * | 9/2003 | Liang | E05C 17/203 16/82 |
| 2004/0075285 | A1 * | 4/2004 | Murayama | E05C 17/203 292/265 |
| 2008/0066260 | A1 * | 3/2008 | Clark | E05C 17/203 16/86 A |
| 2009/0293228 | A1 * | 12/2009 | Sasa | E05C 17/025 16/297 |

FOREIGN PATENT DOCUMENTS

| | | | |
|---|---|---|---|
| EP | 0580147 | A1 | 1/1994 |
| EP | 1728949 | A1 | 12/2006 |
| EP | 2348178 | A2 | 7/2011 |
| WO | 2004065736 | A1 | 8/2004 |
| WO | 2006137381 | A1 | 12/2006 |
| WO | 2008009100 | A1 | 1/2008 |

* cited by examiner

CONSTRUCTION FOR CHECK ARM KEEPER FOR CHECK ARM ASSEMBLY FOR VEHICLE DOOR

CROSS-REFERENCE TO RELATED APPLICATIONS

This application is a continuation in part of, and claims the benefit of priority to, PCT application PCT/CA2015/050572, filed Jun. 22, 2015, which claims the benefit of priority to U.S. Provisional Patent Application No. 62/022,534 filed Jul. 9, 2014, the contents of both of which are incorporated herein in their entirety.

FIELD

This disclosure relates generally to check arm keepers for door check assemblies for vehicle doors.

BACKGROUND

Vehicle doors are typically swung between fully closed and fully opened positions to permit ingress and egress of passengers to and from a vehicle. A door check assembly is typically employed to limit how far open the door can be swung and to provide intermediate positions at which the door can be held. A traditional door check assembly includes a check arm that has several detents and a check arm keeper that employs a spring-loaded plunger that engages a detent to hold the door in an intermediate position. Because vehicle doors are relatively heavy, and because of the geometries involved, the spring that is used to hold the plunger in the detent typically has a relatively high spring rate and is in a state of compression at all times when the keeper is engaged with the check arm.

When assembling a typical check arm keeper, it is relatively difficult to compress the spring in the keeper housing and to enclose the housing so as to hold the spring in a compressed state, due at least in part to the high rate of the spring. It would be advantageous to provide a check arm keeper that is easier to assemble.

Additionally, some check arm keepers are relatively heavy. There is a continuing need to lighten components and assemblies in the automotive industry. Thus it would be advantageous to provide a check arm keeper with reduced weight.

SUMMARY

In an aspect, a kit of parts is provided for a check arm keeper for engagement with a check arm to hold a vehicle door in a selected position. The kit of parts includes a keeper housing and a plunger cartridge. The keeper housing has a mounting bracket and a cartridge-mounting portion. The plunger cartridge includes a plunger cartridge housing that is mountable to the keeper housing, a plunger that is slidable in the plunger cartridge housing, and a plunger-biasing member that is positioned in the plunger cartridge housing to urge the plunger out from the plunger cartridge housing. The plunger has a first engagement member and the plunger cartridge housing has a second engagement member. The first and second engagement members cooperate to retain the plunger in the plunger cartridge housing against a biasing force of the plunger-biasing member when the plunger cartridge is free from the keeper housing. Mounting of the plunger cartridge housing holds the plunger cartridge housing in a selected position relative to the keeper housing and drives the plunger to a position in which the first and second engagement members are spaced from one another.

In another aspect, a method is provided for assembling a check arm keeper for engagement with a check arm to hold a vehicle door in a selected position, comprising:

a) providing a keeper housing having a generally cylindrical cartridge-mounting portion that defines an axis;

b) providing a plunger cartridge including a plunger cartridge housing that is mountable to the cartridge-mounting portion, a plunger that is slidable in the plunger cartridge housing, and a plunger-biasing member that is positioned in the plunger cartridge housing to urge the plunger out from the plunger cartridge housing;

c) insertion of the plunger cartridge axially into the cartridge-mounting portion, wherein during said insertion a projection on one of an exterior surface of the plunger cartridge housing and an inner surface of the cartridge-mounting portion is driven axially in an axially extending portion of a groove in the other of the exterior surface of the plunger cartridge housing and the inner surface of the cartridge-mounting portion, and applying an axially directed force on the plunger cartridge housing that is substantially centered on the plunger-biasing member axially so as to cause compression of the plunger-biasing member axially; and d) rotating the plunger cartridge housing to drive the projection circumferentially in a circumferentially extending portion of the groove, so as to hold the plunger cartridge housing in a selected axial position relative to the keeper housing, and continuing to apply the axially directed force on the plunger cartridge housing that is substantially centered on the plunger-biasing member so as to maintain compression of the plunger-biasing member.

In another aspect, a check arm keeper is provided for engagement with a check arm to hold a vehicle door in a selected position. The check arm keeper includes a keeper housing, a plunger cartridge and a locking structure. The keeper housing has a generally hollow-cylindrical cartridge-mounting portion that defines an axis. The plunger cartridge includes a plunger cartridge housing that is mountable to the cartridge-mounting portion, a plunger that is slidable in the plunger cartridge housing, and a plunger-biasing member that is positioned in the plunger cartridge housing to urge the plunger out from the plunger cartridge housing. The locking structure includes a locking projection on one of an exterior surface of the plunger cartridge housing and an inner surface of the cartridge-mounting portion, and a locking groove in the other of the plunger cartridge housing and the inner surface of the cartridge-mounting portion. The locking groove has a first, axially extending portion and a second, circumferentially extending portion. The plunger cartridge housing has an axial end face with a tool engagement feature for receiving an axial force from a tool, that is generally centered on the plunger-biasing member, and wherein the plunger cartridge is insertable into the cartridge-mounting portion axially to drive the projection along the first portion of the groove, and is rotatable in the cartridge housing to drive the projection along the second portion of the groove while keeping the tool fixed in position in the tool engagement feature so as to maintain the axial force generally centered on the plunger-biasing member.

In another aspect, a method is provided for assembling a check arm keeper for engagement with a check arm to hold a vehicle door in a selected position, comprising:

a) providing a keeper housing having a generally hollow-cylindrical cartridge-mounting portion that defines an axis;

b) providing a plunger cartridge including a plunger cartridge housing that is mountable to the cartridge-mounting portion, a plunger that is slidable in the plunger cartridge housing, and a plunger-biasing member that is positioned in the plunger cartridge housing to urge the plunger out from the plunger cartridge housing;

c) using a tool to insert the plunger cartridge axially into the cartridge-mounting portion, wherein during said insertion a projection on one of an exterior surface of the plunger cartridge housing and an inner surface of the cartridge-mounting portion is driven axially in an axially extending portion of a groove in the other of the exterior surface of the plunger cartridge housing and the inner surface of the cartridge-mounting portion, and applying an axially directed force on the plunger cartridge housing on the plunger-biasing member so as to cause compression of the plunger-biasing member axially; and d) using the tool to rotate the plunger cartridge housing to drive the projection circumferentially in a circumferentially extending portion of the groove, so as to hold the plunger cartridge housing in a selected axial position relative to the keeper housing, and continuing to apply the axially directed force on the plunger cartridge housing while keeping the tool fixed in position relative to the plunger-biasing member and relative to the plunger cartridge housing.

Other inventive aspects of the present disclosure will become readily apparent based on the teachings contained herein.

BRIEF DESCRIPTION OF THE DRAWINGS

The foregoing and other aspects will now be described by way of example only with reference to the attached drawings, in which.

DETAILED DESCRIPTION

Figure 1:
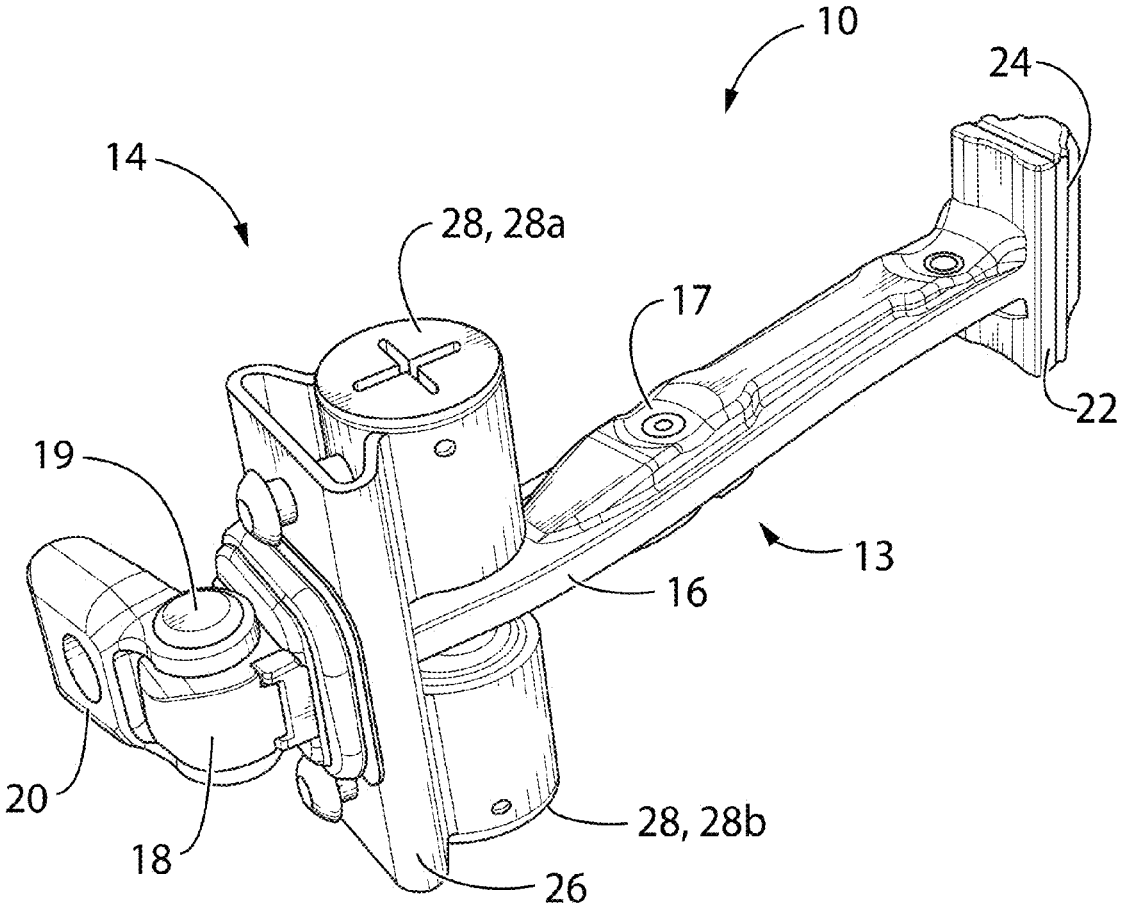
FIG. 1 is a perspective view of a check arm assembly for a vehicle door, in accordance with an embodiment of the present invention.

Reference is made to FIG. 1, which shows a vehicle door check assembly 10, in accordance with an embodiment of the present invention. The check assembly 10 is used to control the opening and closing of a vehicle door 11 relative to a vehicle body 12. The vehicle body 12 may be any substantially fixed portion of the vehicle, such as the frame and the body panels.

Figure 6:
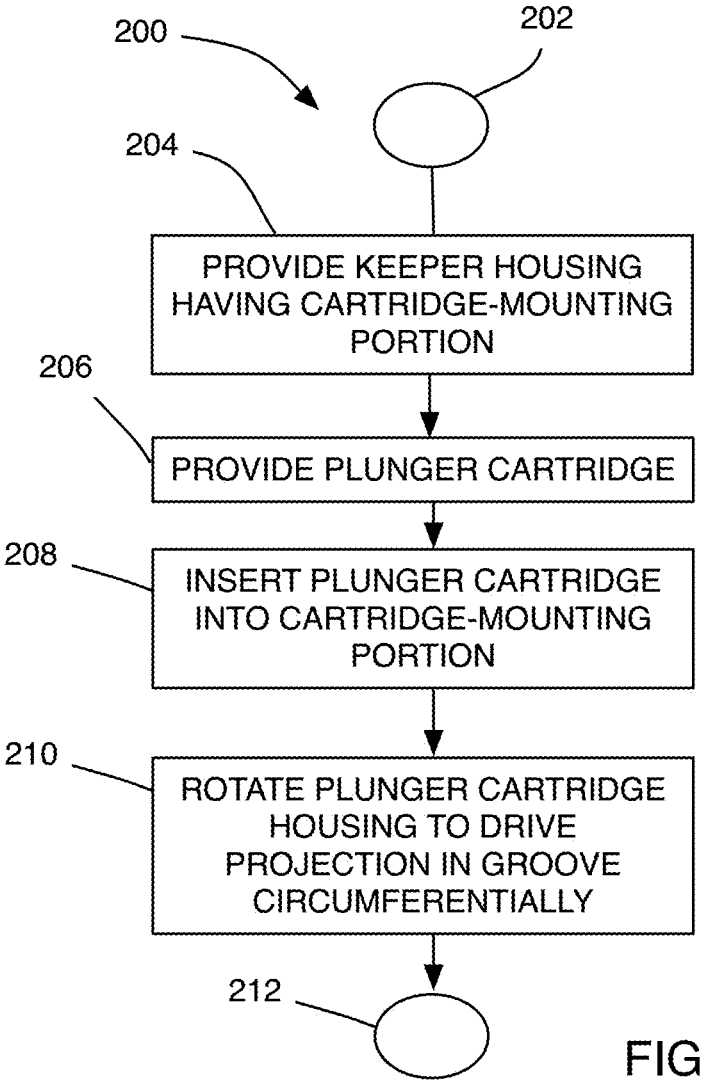
FIGS. 6 and 7 are flow diagrams illustrating methods of assembly of the check arm keeper shown in FIG. 2.

The door check assembly 10 includes a check arm 13 and a check arm keeper 14. The check arm 13 may be of known construction and has a check arm body 16 that passes through the keeper 14. The body 16 may have at least one detent 17 thereon. A first end 18 of the check arm body 16 is pivotally connectable to the vehicle body 12 (FIG. 6) via a pin joint 19 (FIG. 1) with a mounting bracket 20. At a second end 22 (FIG. 1) of the check arm body 16 is an end stop 24 that engages the check arm keeper 14 to limit the maximum opening angle of the vehicle door 12 (FIG. 6).

Figure 2:
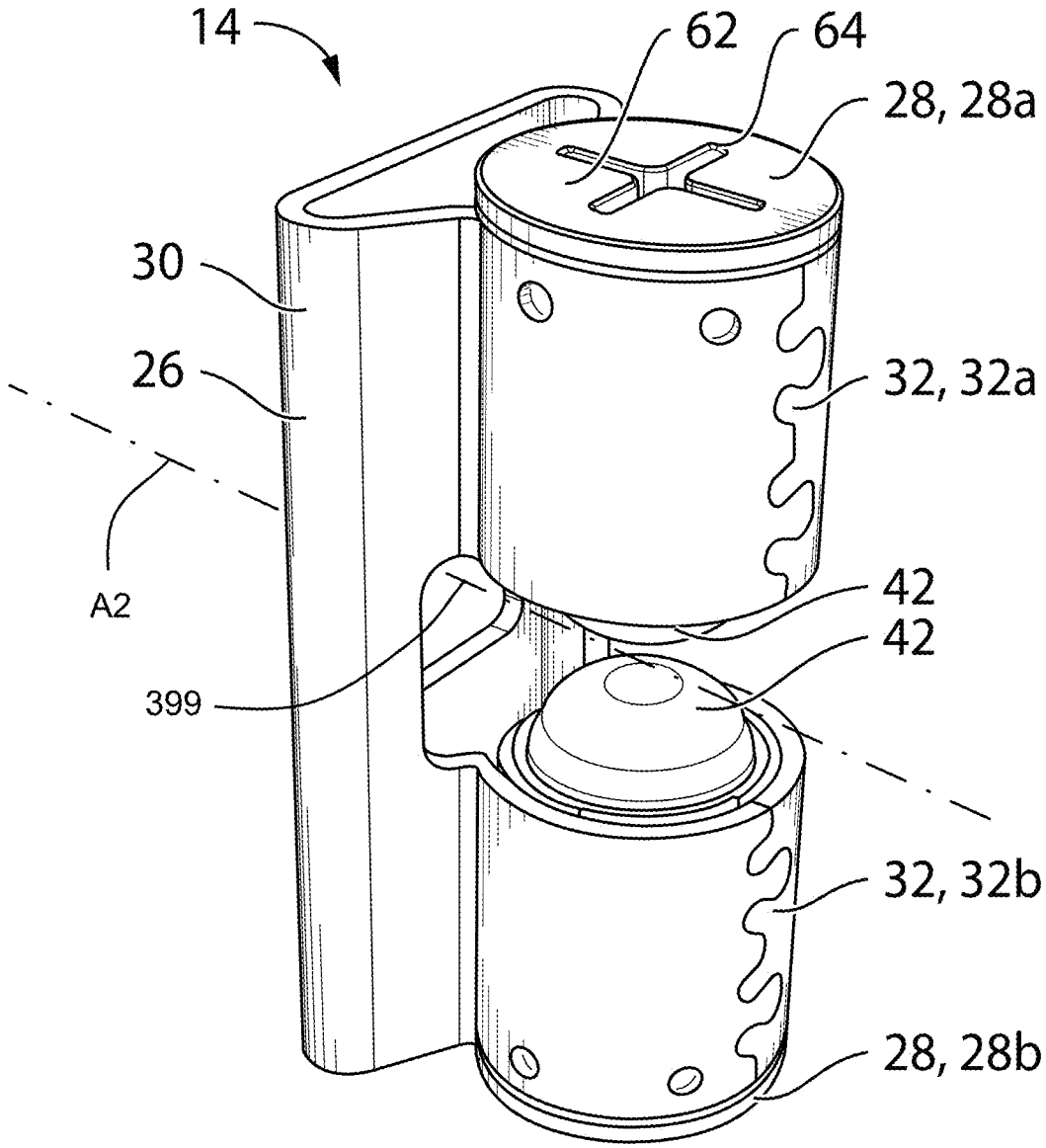
FIG. 2 is a perspective view of a check arm keeper that is part of the check arm assembly shown in FIG. 1.
Figure 3:
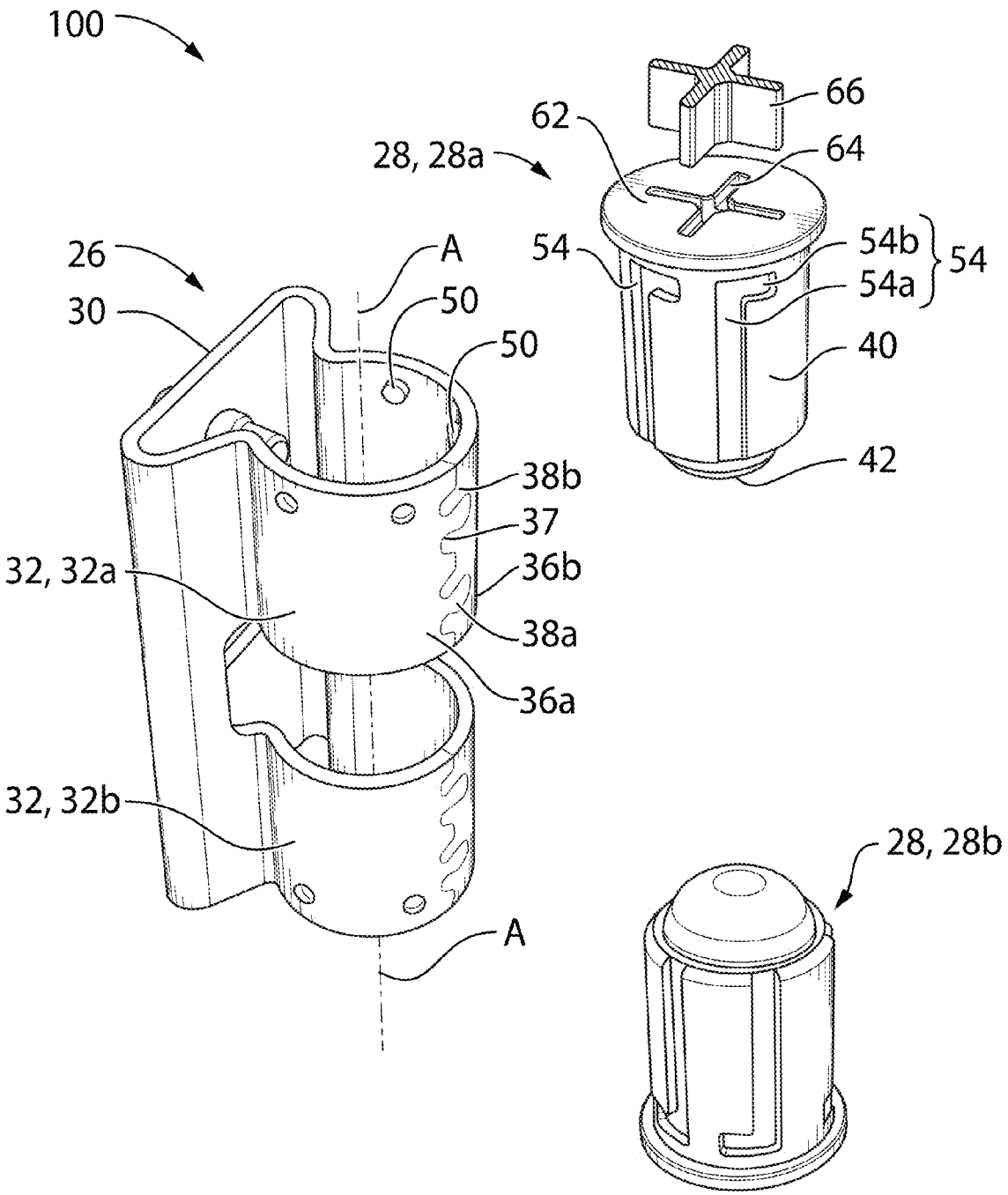
FIG. 3 is an exploded perspective view of a keeper housing and two plunger cartridges that are part of the check arm keeper shown in FIG. 2.

The check arm keeper 14 is mounted to the door 12, and includes a keeper housing 26 and at least one plunger cartridge 28. In the embodiment shown, two plunger cartridges are shown at 28*a* and 28*b* respectively. The check arm keeper 14 is shown in more detail in FIGS. 2-5. With reference to FIG. 3, the keeper housing 26 includes a mounting bracket portion 30 and at least one cartridge-mounting portion 32 that defines an axis A. Each cartridge-mounting portion 32 lockably receives one of the plunger cartridges 28. In the embodiment shown, there are two such cartridge-mounting portions, shown at 32*a* and 32*b* respectively, one for each plunger cartridge 28, with their axes A aligned with one another.

The keeper housing 26 may be formed from a contiguous piece of sheet metal. In the embodiment shown, the keeper housing 26 is formed in a progressive die process wherein first and second wings 36*a* and 36*b* are progressively folded over towards each other, and to form an interlocking seam 37 at their respective ends shown at 38*a* and 38*b*. Once their ends 38*a* and 38*b* overlap one another, they are pressed together so as to interlock with one another thereby forming a closed shape. Alternatively, any other suitable forming process may be used to form the keeper housing 26. As another alternative, the keeper housing 26 may have any other suitable structure. For example, the keeper housing 26 may be formed from a polymeric material and may be injection molded.

Figure 4:
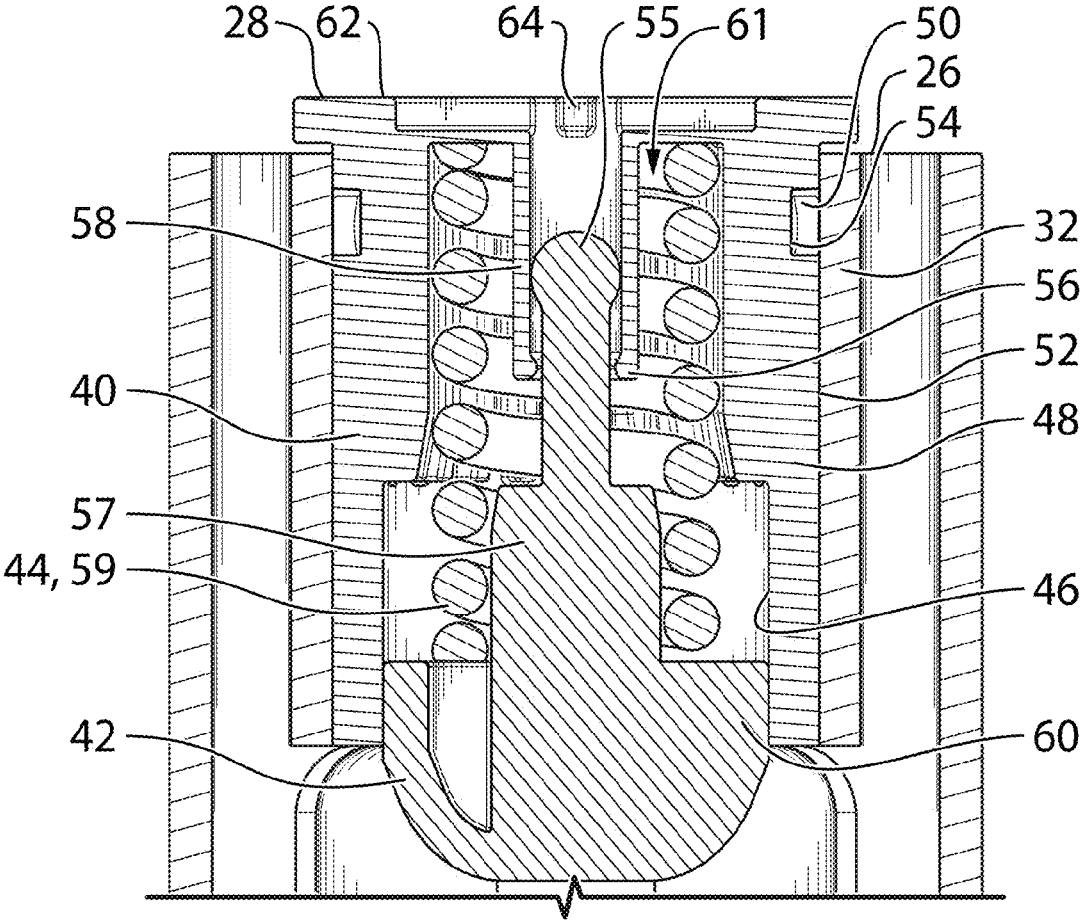
FIG. 4 is a sectional elevation view of one of the plunger cartridges shown in FIG. 3.

As shown in FIG. 3, the plunger cartridges 28 may be mounted to the keeper housing 26 in facing relationship to one another. Referring to FIG. 4, each plunger cartridge 28 includes a plunger cartridge housing 40, a plunger 42 and a plunger-biasing member 44. The plunger cartridge housing 40 is mountable to the keeper housing 26 (FIG. 3) by any suitable means. For example, the associated cartridge-mounting portion 32 may be generally hollow-cylindrical and may have an inner surface 46. The plunger cartridge housing 40 may have a radially outer wall 48 that is received in the cartridge-mounting portion 32, and locks therewith to resist axial forces on the plunger cartridge housing 40 during use of the door check assembly 10.

In the embodiment shown, the locking engagement between the cartridge-mounting portion 32 and the plunger cartridge housing 40 is provided by any suitable locking structure. In the example shown in the figures, the locking structure may include one or more locking projections 50 that are engageable with one or more locking grooves 54. A plurality of cartridge locking projections 50 are shown in FIG. 3 positioned on one of the exterior surface (shown at 52) of the radially outer wall 48 of the plunger cartridge housing 40 and the inner surface 46 of the cartridge-mounting portion 32. Each cartridge locking projection 50 is engageable with a cartridge locking groove 54 in the other of the exterior surface 52 of the radially outer wall 48 of the plunger cartridge housing 40 and the inner surface 46 of the cartridge-mounting portion 32. In the embodiment shown, the projection 50 is provided on the inner surface 46 of the cartridge-mounting portion 32 and the groove 54 is provided on the plunger cartridge housing 40.

The groove 54 has a first groove portion 54*a* that extends generally axially and a second groove portion 54*b* that extends generally circumferentially. The first (axial) groove portion 54*a* permits the axial insertion of the plunger cartridge housing 40 into the cartridge-mounting portion 32 by a selected amount. The second (circumferential) groove portion 54*b* permits the locking of the plunger cartridge housing 40 against axial forces. While the first and second groove portions 54*a* and 54*b* are shown to extend directly axially and directly circumferentially, it will be understood that they need not extend directly axially and circumferentially to function to permit the axial insertion of the plunger cartridge housing 40 into the cartridge-mounting portion 32 and the locking of the plunger cartridge housing 40 relative to the keeper housing 26 against axial forces.

Referring to FIG. 4, the plunger 42 is slidable in the plunger cartridge housing 40. The plunger-biasing member 44 is positioned in the plunger cartridge housing 40 to urge the plunger 42 out from the housing 40. The plunger 42 has a first engagement member 55 and the plunger cartridge housing 40 has a second engagement member 56. The first and second engagement members 55 and 56 are flexible enough to permit then to be moved past each other when the plunger 42 is inserted into the plunger cartridge housing 40, but cooperate to retain the plunger 42 in the plunger cartridge housing 40 against a biasing force of the plunger-biasing member 44 when the plunger cartridge is free from the keeper housing 26. As a result, the components of the plunger cartridge 28 (i.e. the plunger cartridge housing 40, the plunger 42 and the biasing member 44) can be assembled together to form a subassembly that can be formed and then carried as one unit over to the keeper housing 26 for insertion therein.

Referring to FIG. 4, the first engagement member 55 may be provided on a central projection 57 provided on the plunger 42, while the second engagement member 56 may be positioned in a projection receiving tube 58 provided on the plunger cartridge housing 40. In embodiments wherein the plunger-biasing member 44 is a helical coil compression spring 59, the compression spring may be positioned in surrounding relationship with the central projection 57 and the projection receiving tube 58, thereby stabilizing the spring 59 during compression of the spring 59, which occurs when the plunger 42 is pushed into the plunger cartridge housing 40. Additionally, a radially outer wall (shown at 60) of the plunger 42 may cooperate with the radially outer wall 48 of the plunger cartridge housing 40 to stabilize the spring 59 during compression thereof by surrounding the outside of the spring 59, while the central projection 57 and the receiving tube 58 stabilize the spring 59 from within the central aperture (shown at 61) of the spring 59. It will be further noted that, it is via engagement of the plunger radially outer wall 60 with the housing radially outer wall 48, and via engagement of the central projection 57 with the receiving tube 58 that sliding engagement is provided between the plunger 42 and the plunger cartridge housing 40.

Mounting of the plunger cartridge 28 to the keeper housing 26, (i.e. insertion and locking of the plunger cartridge 28 relative to the keeper housing 26), locks the plunger cartridge housing 40 in a selected axial position relative to the keeper housing 26 and drives the plunger 42 to a position in which the first and second engagement members 55 and 56 are spaced from one another, as shown in FIG. 4.

During insertion of the plunger cartridge 28 into the keeper housing 26, the check arm 13 is already present through the keeper housing 26. As a result, the biasing force being applied by the biasing member 44 on the plunger cartridge housing 40 and the plunger 42 may be very high as the plunger 42 retracts into the plunger cartridge housing 40 during insertion of the plunger cartridge 28. The plunger cartridge housing 40 has an axial end face 62 that has a tool engagement feature 64 (FIG. 4) having any suitable shape for receiving an axial force and a rotational force. An example shape that is generally a +-shape is shown in FIGS. 2 and 3. To insert the cartridge 28 (FIG. 4) into the keeper housing 26 (FIG. 3), a suitable tool (the tip of which is shown at 66 in FIG. 3), may be inserted into the tool engagement feature 64 (FIG. 4), and may be driven axially (either manually be an assembly person or by a suitable machine) to drive the plunger cartridge housing 40 into the keeper housing 26, thereby compressing the biasing member 44. In the embodiment shown, the tool engagement feature 64 permits the plunger cartridge housing 40 to then be rotated once inserted sufficiently so as to carry the locking projection 53 along the circumferential portion 54*b* of the locking groove 54, while still maintaining a generally centered compressive force on the biasing member 44. By contrast, in some check arm keepers of the prior art, a tool is used to axially compress a plunger spring, while a cover plate is slid laterally in a slot in a housing to cover the compressed plunger spring. This can be an awkward operation because there is a point at which the tool and the cover plate both occupy the end of the plunger spring, but where neither of them is centered on the end of the plunger spring. By contrast, when assembling the keeper 14 in accordance with an embodiment of the present invention, the engagement of the tool 66 on the plunger cartridge housing 40 and the engagement of the plunger cartridge housing 40 on the plunger-biasing member 44 remains centered throughout the compression and locking of the plunger cartridge 28 in the keeper housing 26, thereby facilitating mounting of the cartridge 28 in the keeper housing 26. Put another way, the plunger cartridge 28 is insertable into the cartridge-mounting portion 32 axially and a suitable axial force (shown at F1 in FIG. 3) is used to drive the projections 50 axially along the first portion of the grooves 54. When the plunger cartridge housing 40 is sufficiently inserted (i.e. when the projections 50 have reached the bottoms of the first groove portions 54*a*), the plunger cartridge housing 40 is rotatable via rotary force F2 (FIG. 3), so as to drive the projections 50 along the second portions 54*b* of the grooves 54, all while keeping the tool 66 fixed in position in the tool engagement feature 64 so as to maintain an axial force that is generally centered on the plunger-biasing member 44.

It is advantageous that the force exerted on the biasing member 44 that results from engagement of the tool 66 with the plunger cartridge housing 40 remains centered on the biasing member 44. By contrast, when the force exerted by the tool is offset from the center of the spring, as is the case at some points in time in some embodiments of the prior art, there is a risk that the spring will slip out from the tool and will eject itself from the assembly.

As a separate point, it is advantageous that the tool 66 remains stationary relative to the plunger cartridge housing 40 and stationary relative to the spring 59 throughout the insertion and locking of the plunger cartridge 28 in the keeper housing 26. By contrast, in some embodiments of the prior art, as a cover plate is slid in over an end of the spring, the tool that is used to compress the spring is moved laterally to make room for the cover plate to take over holding of the spring in the compressed state. This movement of the tool must be carried out carefully so that the spring does not break free of the tool and eject itself from the assembly, but it must be carried out sufficiently quickly to ensure that there is no interference between the tool and the cover plate being slid into place over end of the spring.

In general, where it is stated that the force exerted on the spring 59 is centered on the spring 59, or that the force exerted by the tool 66 is centered on the spring 59, it will be understood that the force may be exerted by the tool 66 on a plurality of discrete points on the plunger cartridge housing 40 (e.g. points around the periphery of the housing 40), whereby the net force resulting from the forces at the discrete points is generally centered on the spring 59.

It will be understood that there may be any suitable number of locking projections 52 and grooves 54. In the embodiment shown there are four projections 52 and four grooves 54, spaced apart about the circumferences of the cartridge-mounting portion 32 and the exterior surface 52 of the plunger cartridge housing 40. In some embodiments there could be as few as one projection 53 and one groove 54, although a plurality of projections 52 and grooves 54 is preferred in at least some embodiments.

The keeper housing 26 and the plunger cartridges 28 may be considered to be a kit of parts 100 that is used to form the check arm keeper 14. It will be noted that this kit of parts may be an intermediate stage of the manufacture of the check arm keeper 14 and in the manufacture of the door check assembly 10. In other words, the kit of parts 100 may exist as a separate keeper housing 26 and separate cartridges 28 only temporarily during the manufacture of the keeper 14 and during the manufacture of the check arm assembly 10, while the completed assembly 10 may be what is ultimately sold to a vehicle manufacturer. Nonetheless, manufacture of the assembly 10 by first providing the kit of parts 100 and then assembling the keeper 14 and the door check assembly 10 from the kit of parts 100 is advantageous in that the kit of parts 100 facilitates the process of assembling the keeper 14 and the door check assembly 10.

In the embodiment shown, the keeper 14 includes two plunger cartridges, however, it will be understood that a check arm keeper could be provided with a single plunger cartridge 28 that mounts in a keeper housing 26 that includes only one cartridge-mounting portion 32.

FIG. 6 is a flow diagram illustrating a method 200 of assembling a check arm keeper such as the check arm keeper 14 shown in FIG. 2, for engagement with a check arm such as check arm 13 to hold a vehicle door in a selected position. The method begins at 202. At step 204, a keeper housing (such as keeper housing 26) is provided, and has a generally hollow-cylindrical cartridge-mounting portion (such as cartridge-mounting portion 32) that defines an axis. At step 206 a plunger cartridge (such as plunger cartridge 28) is provided and includes a plunger cartridge housing (such as plunger cartridge housing 40) that is mountable to the cartridge-mounting portion, a plunger (such as plunger 42) that is slidable in the plunger cartridge housing, and a plunger-biasing member (such as biasing member 44) that is positioned in the plunger cartridge housing to urge the plunger out from the plunger cartridge housing. At step 208 the plunger cartridge is inserted axially into the cartridge-mounting portion. During the insertion a projection such as projection 50 on one of an exterior surface of the plunger cartridge housing and an inner surface of the cartridge-mounting portion is driven axially in an axially extending portion of a groove such as groove 54 in the other of the exterior surface of the plunger cartridge housing and the inner surface of the cartridge-mounting portion. An axially directed force is applied on the plunger cartridge housing that is substantially centered on the plunger-biasing member so as to cause compression of the plunger-biasing member axially. At step 210, the plunger cartridge housing is rotated to drive the projection circumferentially in a circumferentially extending portion of the groove, so as to hold the plunger cartridge housing in a selected axial position relative to the keeper housing. The axially directed force is applied on the plunger cartridge housing and is substantially centered on the plunger-biasing member so as to maintain compression of the plunger-biasing member. The method 200 ends at 212.

Figure 7:
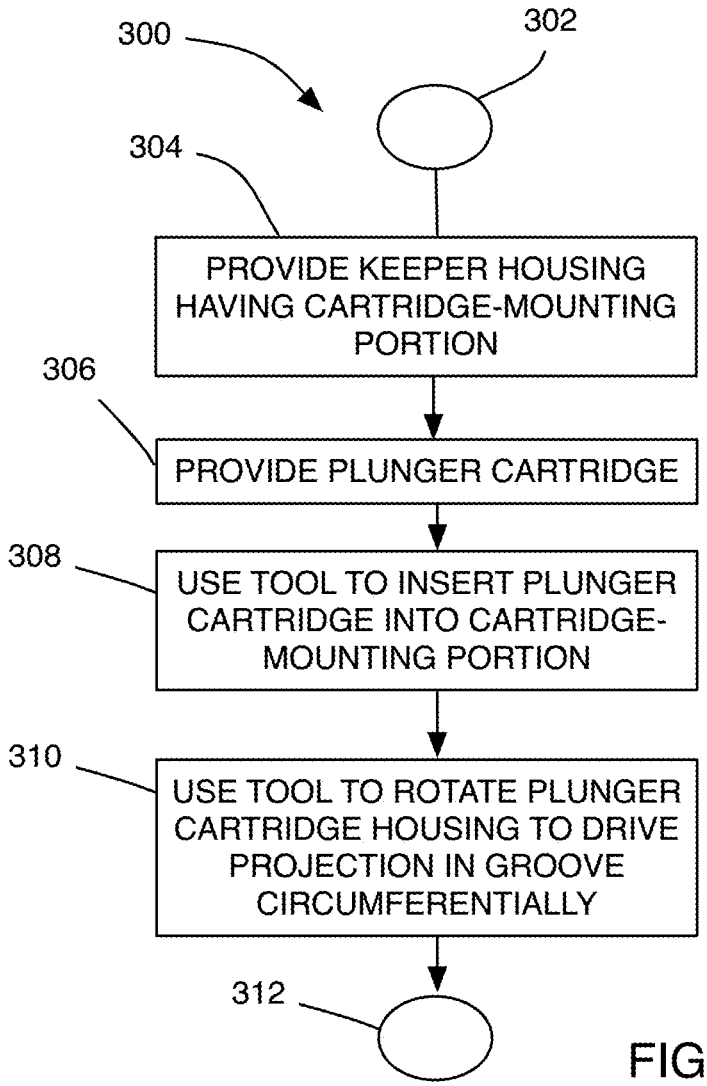

FIG. 7 is a flow diagram illustrating another method 300 for assembling a check arm keeper such as the check arm keeper 14 for engagement with a check arm such as check arm 13 to hold a vehicle door in a selected position. The method starts at 302. At step 304 a keeper housing such as keeper housing 26 is provided and has a generally hollow-cylindrical cartridge-mounting portion such as cartridge-mounting portion 32 that defines an axis. At step 306, a plunger cartridge (such as plunger cartridge 28) is provided and includes a plunger cartridge housing such as plunger cartridge housing 40 that is mountable to the cartridge-mounting portion, a plunger such as plunger 42 that is slidable in the plunger cartridge housing, and a plunger-biasing member such as biasing member 44 that is positioned in the plunger cartridge housing to urge the plunger out from the plunger cartridge housing. At step 308 a tool such as tool 66 is used to insert the plunger cartridge axially into the cartridge-mounting portion, wherein during said insertion a projection such as projection 50 on one of an exterior surface of the plunger cartridge housing and an inner surface of the cartridge-mounting portion is driven axially in an axially extending portion of a groove such as groove 54 in the other of the exterior surface of the plunger cartridge housing and the inner surface of the cartridge-mounting portion. An axially directed force is applied on the plunger cartridge housing on the plunger-biasing member so as to cause compression of the plunger-biasing member axially. At step 310 the tool is used to rotate the plunger cartridge housing to drive the projection circumferentially in a circumferentially extending portion of the groove, so as to hold the plunger cartridge housing in a selected axial position relative to the keeper housing, and continuing to apply the axially directed force on the plunger cartridge housing while keeping the tool fixed in position relative to the plunger-biasing member and relative to the plunger cartridge housing. The method 300 ends at 312.

Figure 5:
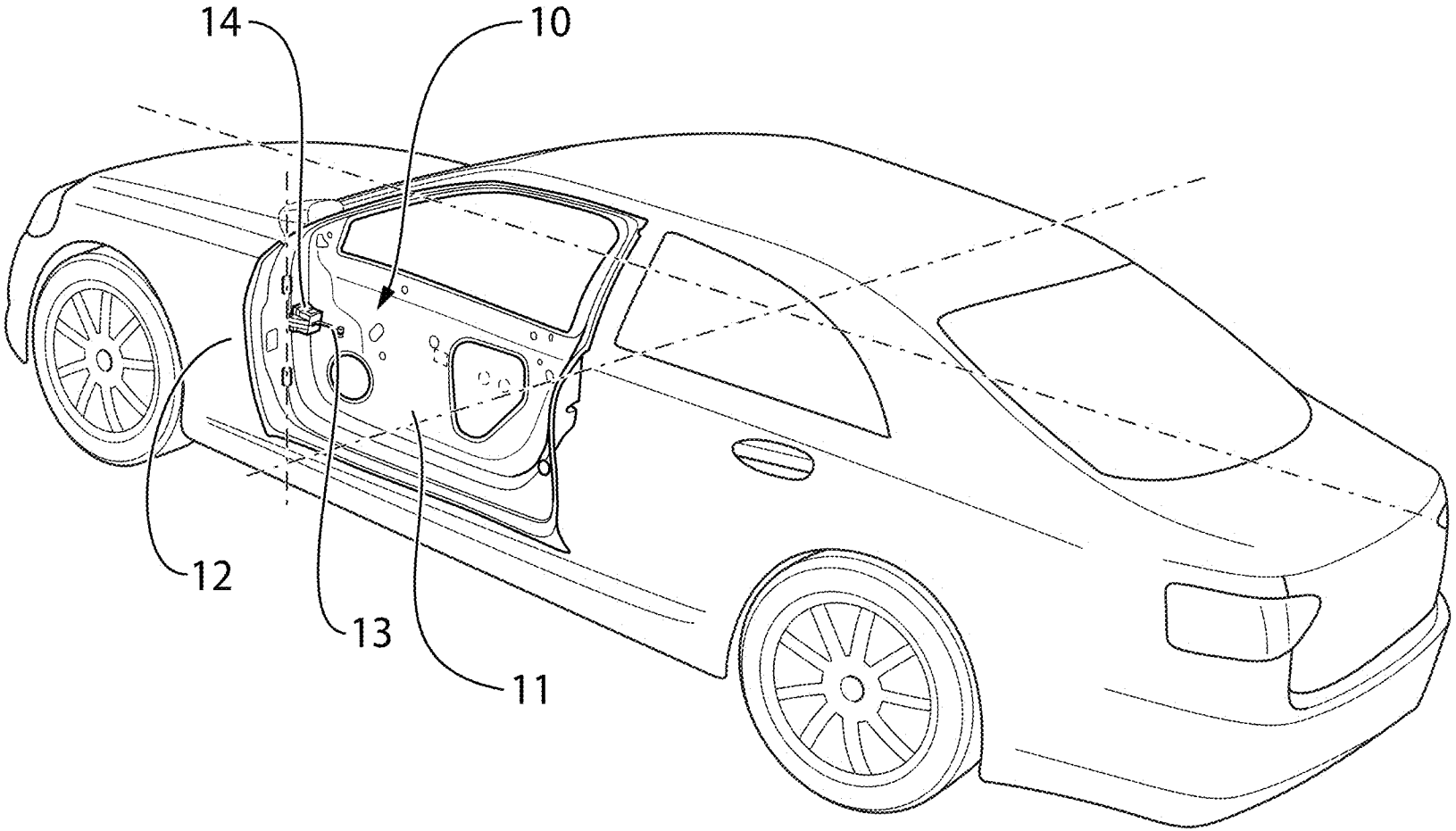
FIG. 5 is an elevation view of a vehicle incorporating the check arm assembly shown in FIG. 1.
Figure 8:
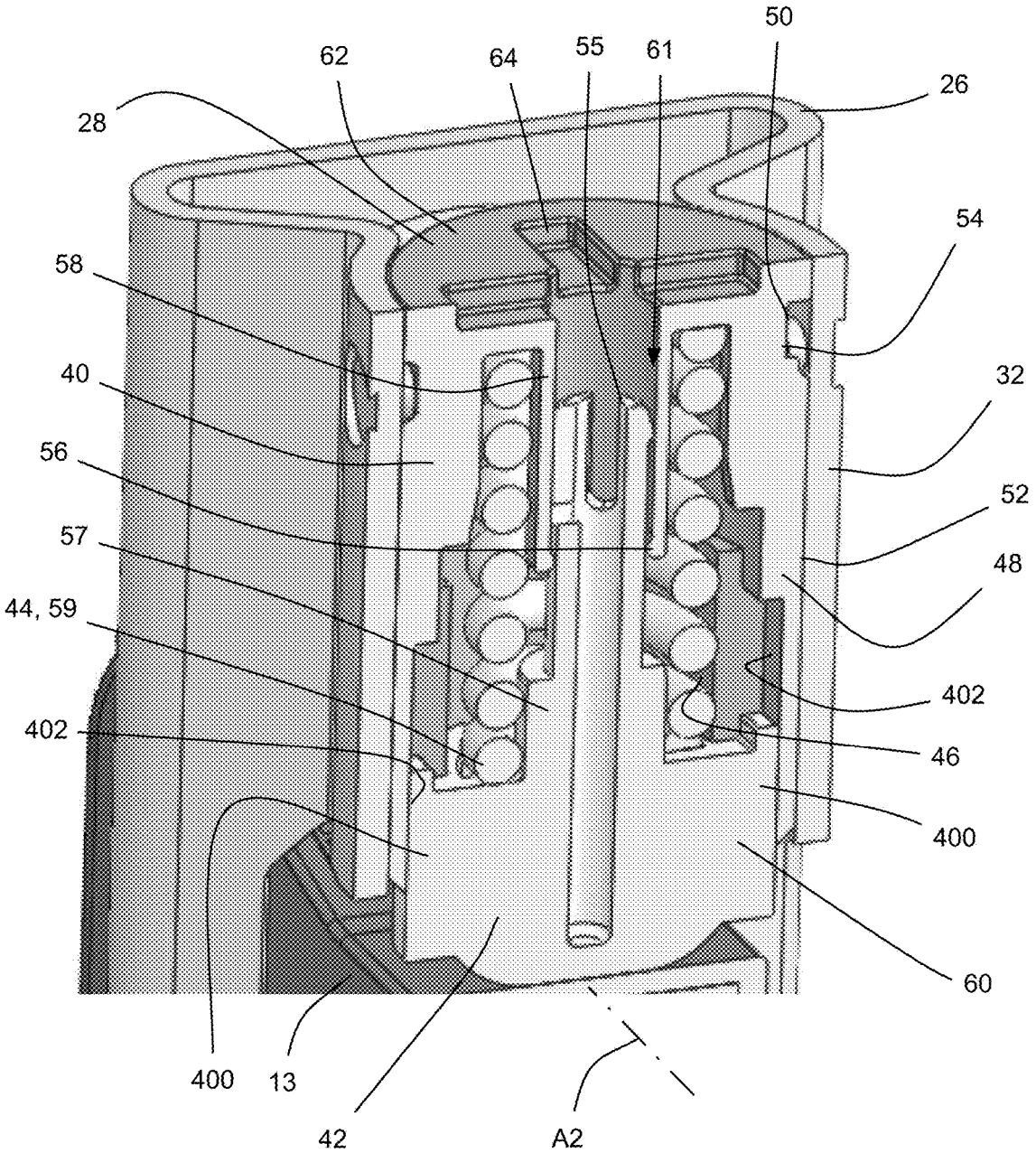
FIG. 8 is a perspective sectional view of a check arm assembly in accordance with another embodiment of the present invention.
Figure 9:
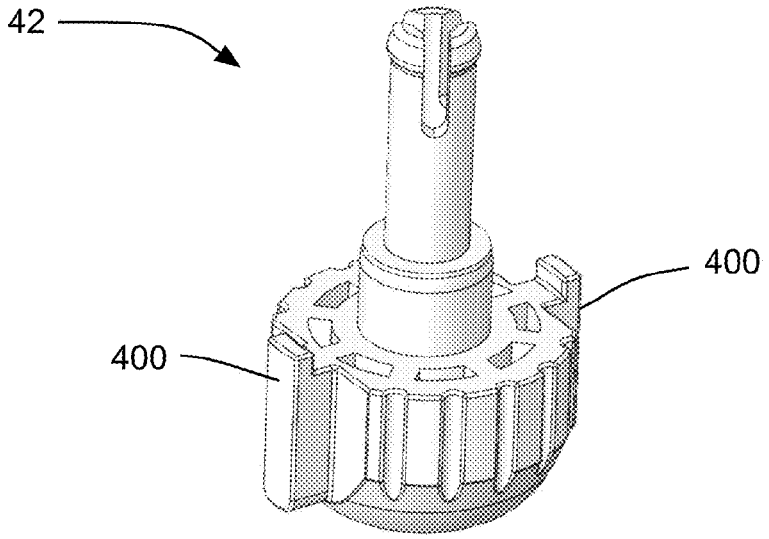
FIG. 9 is a perspective view of a plunger shown in FIG. 8.
Figure 10:
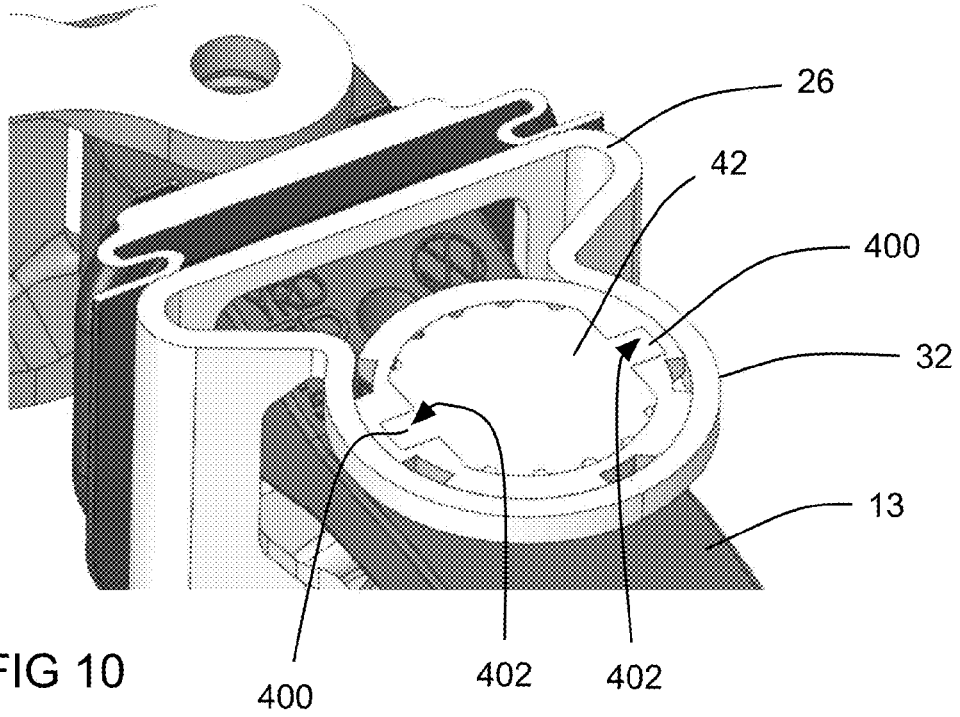
FIG. 10 is a perspective sectional view of the check arm assembly shown in FIG. 8.

FIGS. 8-10 show the door check assembly 10 shown in FIGS. 1-4, but with some additional, optional features. To describe these features it will be noted that the keeper housing 26 includes a check arm aperture 399 that permits the pass-through of the check arm 13. The check arm aperture 399 defines an axis A2 that corresponds generally to an axis along with the check arm 13 travels through the check arm keeper 14. This is also an axis along with forces are applied by the check arm 13 on the plungers 42 when the vehicle door 11 (FIG. 5). The plunger 42 in FIGS. 8-10 includes fins 400 that extend generally perpendicularly to the axis A2 and which are received in guide slots 402 that are provided in the plunger cartridge housing 40. It is alternatively possible for the fins 400 to be provided on the plunger cartridge housing 40 and for the guide slots 402 to be provided on the plunger 42. It is also possible to provide a single fin 400 and a single guide slot 402, instead of a plurality of fins 400 and guide slots 402 although one fin 400 on each side of the plunger 42 is preferred. By providing the at least one fin 400 and the at least one guide slot 402, the plunger 42 is less prone to bending or pivoting while engaged with the check arm 13.

Figure 11:
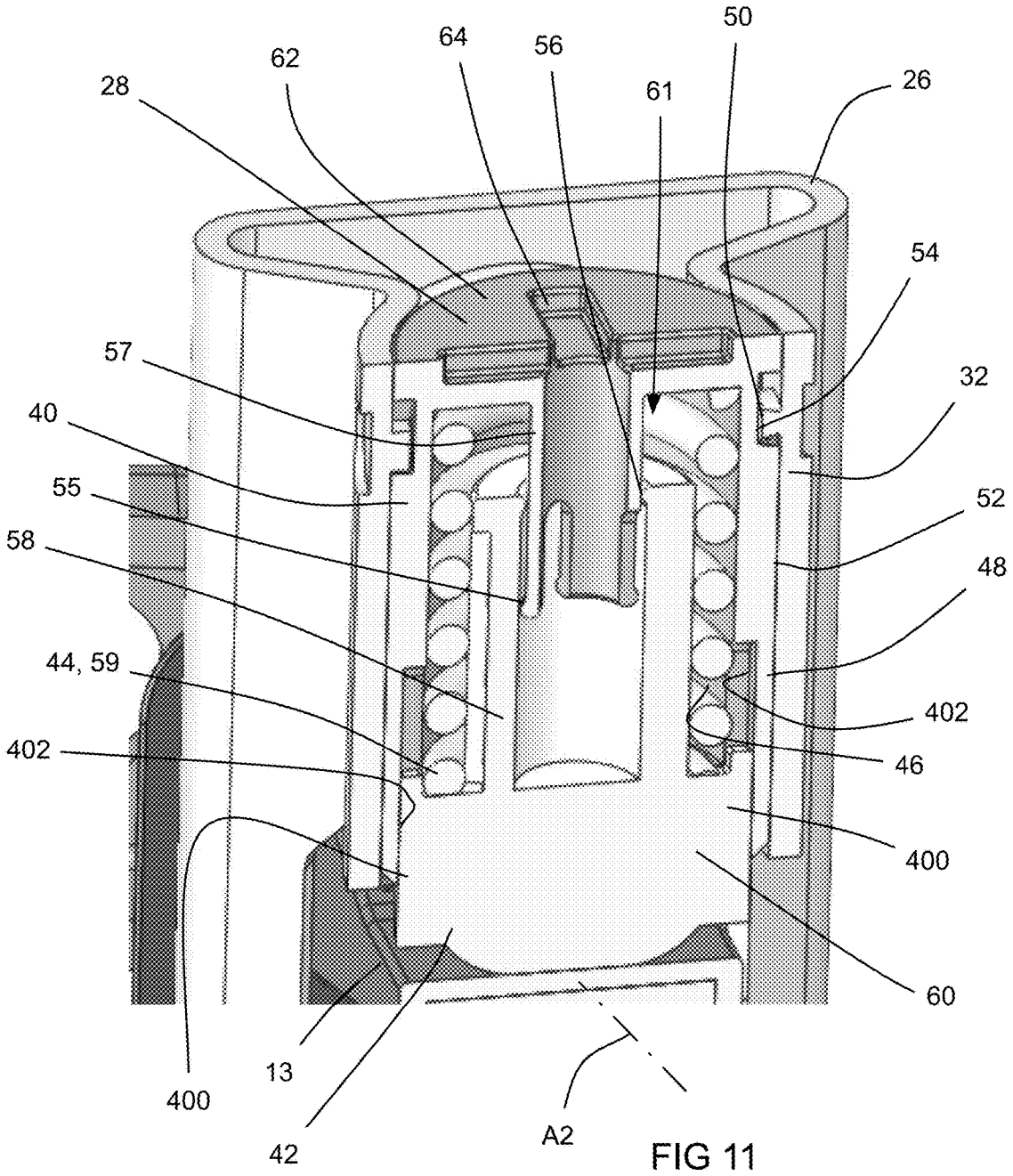
FIG. 11 is a perspective sectional view of a check arm assembly in accordance with another embodiment of the present invention.
Figure 12:
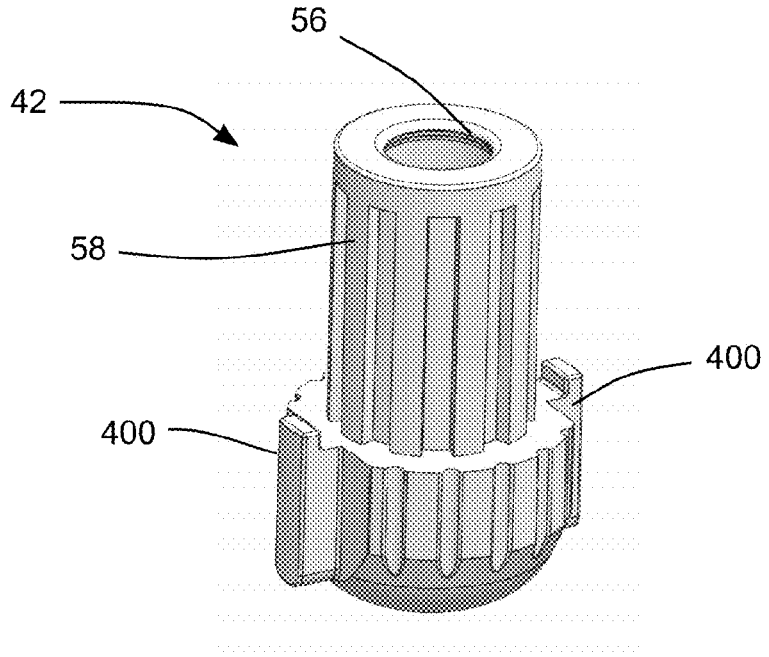
FIG. 12 is a perspective view of a plunger shown in FIG. 11.
Figure 13:
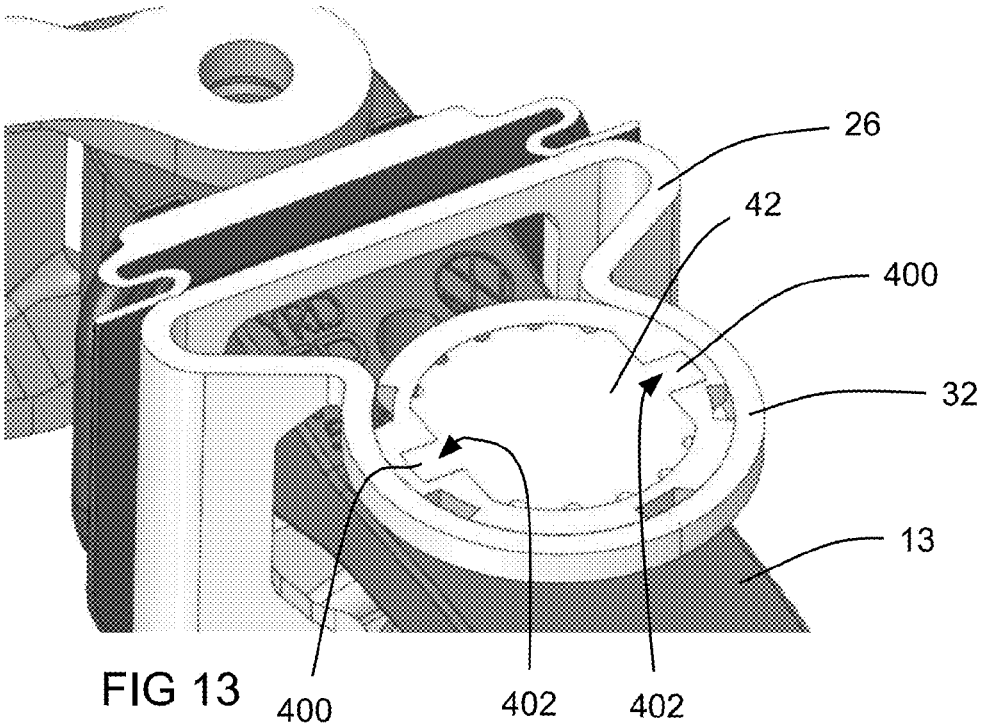
FIG. 13 is a perspective sectional view of the check arm assembly shown in FIG. 11.

Reference is made to FIGS. 11-13, which show the door check assembly 10 shown in FIGS. 8-10, but with an additional, optional feature, which is that the first engagement member 55 is provided on a central projection 57 plunger cartridge housing 40, while the second engagement member 56 may be positioned in a projection receiving tube 58 provided on the plunger 42. The using the structure shown at 58 in FIG. 4 as the central projection 57 that is received in the projection receiving tube 58 on the plunger 42, the plunger further resists being caused to bend or be dragged with the check arm 13, due to the larger diameter at the surface at which the central projection 55 and the projection receiving tube 58 are received.

Additionally, to accommodate this structure, the spring 59 has been enlarged as compared to the spring 59 shown in FIGS. 1-4.

Figure 14:
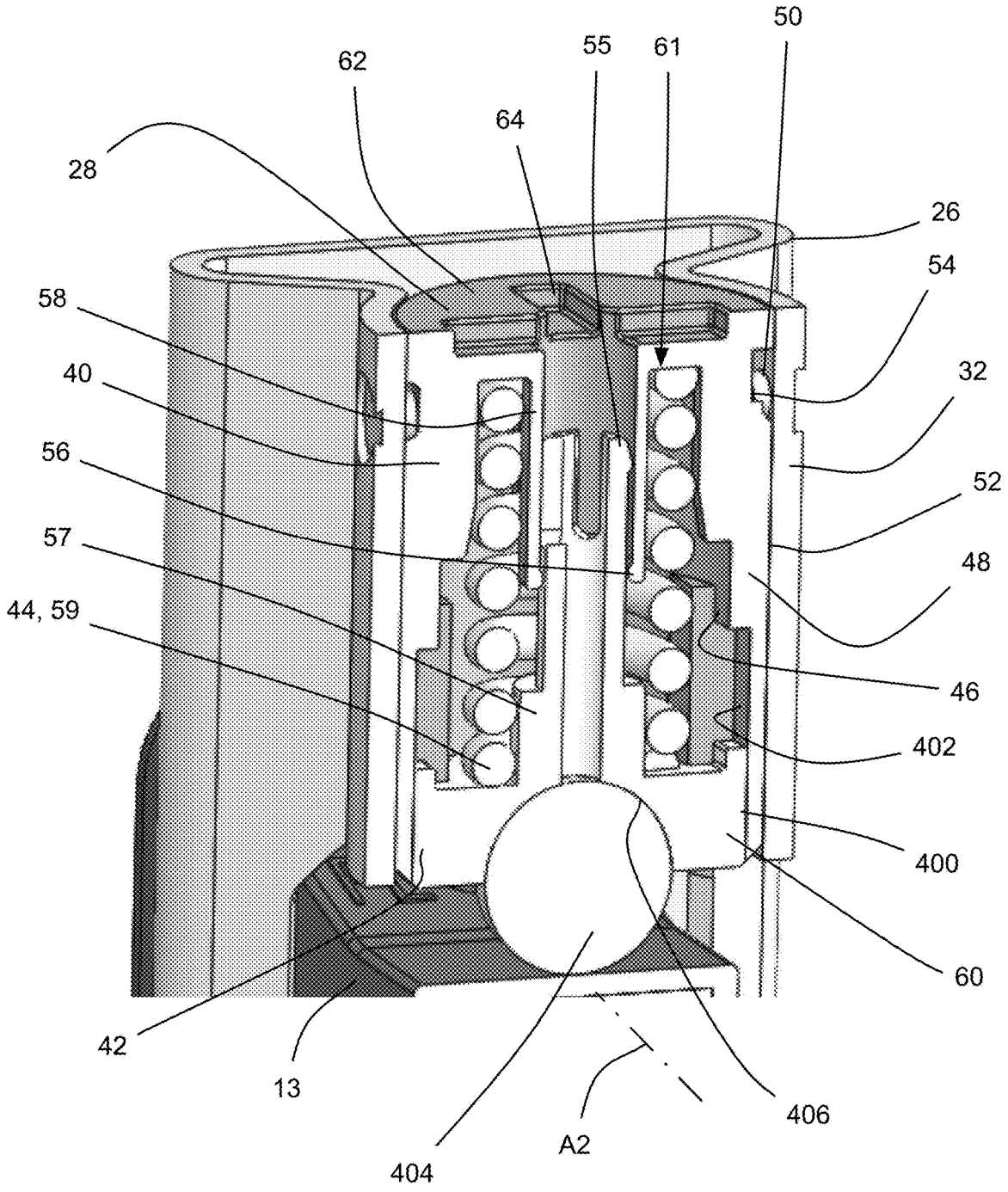
FIG. 14 is a perspective sectional view of a check arm assembly in accordance with another embodiment of the present invention.

Reference is made to FIG. 14 which shows yet another alternative plunger 42, which may be similar the plunger shown in FIGS. 8-10 but which includes a ball 404 positioned in a pocket 406 in the plunger 42, and positioned for engagement with the check arm 13 during use. The ball may be made from a metal such as a suitable steel. The ball 404 can roll along as the check arm 13 moves during opening and closing of the door, thereby reducing the bending forces or drag forces that pull on the plunger 42.

Figure 15:
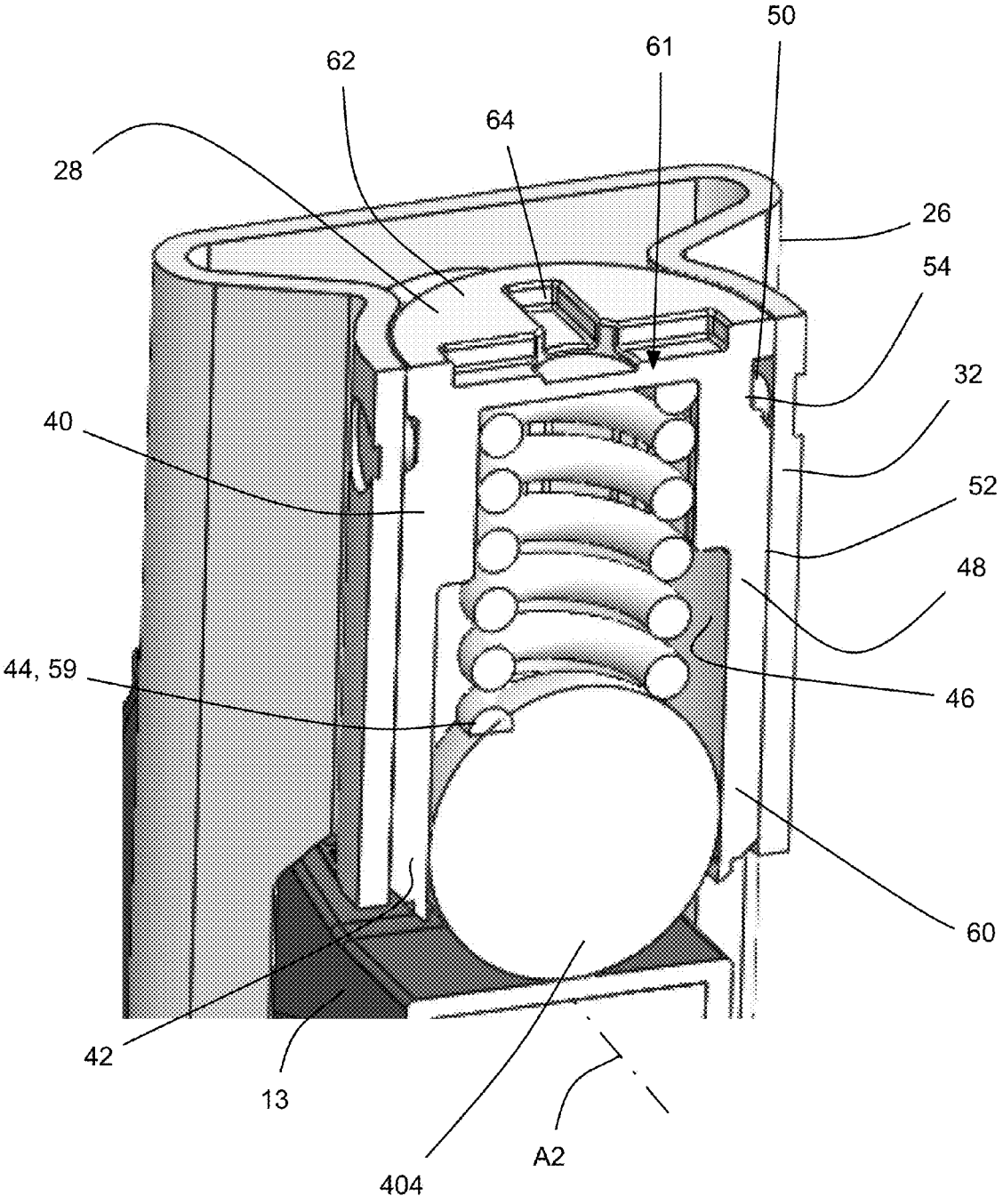
FIG. 15 is a perspective sectional view of a check arm assembly in accordance with another embodiment of the present invention.

FIG. 15 shows yet another alternative plunger 42 which is a ball 408 in itself without any polymeric member to hold it. This saves the cost associated with producing the polymeric portion of the plunger 42 in FIG. 14.

While the above description constitutes specific examples, these examples are susceptible to further modification and change without departing from the fair meaning of the accompanying claims.

The invention claimed is:

1. A kit of parts for a check arm keeper for engagement with a check arm to hold a vehicle door in a selected position, comprising:

a keeper housing that has a mounting bracket and a cartridge-mounting portion; and a plunger cartridge including a plunger cartridge housing that is mountable to the keeper housing, a plunger that is slidable in the plunger cartridge housing, and a plunger-biasing member that is positioned in the plunger cartridge housing to urge the plunger out from the plunger cartridge housing, wherein the plunger has a first engagement member and the plunger cartridge housing has a second engagement member, wherein the first and second engagement members cooperate to retain the plunger in the plunger cartridge housing against a biasing force of the plunger-biasing member when the plunger cartridge is free from the keeper housing, and wherein mounting of the plunger cartridge housing holds the plunger cartridge housing in a selected position relative to the keeper housing and drives the plunger to a position in which the first and second engagement members are spaced from one another.

2. A kit of parts for a check arm keeper as claimed in claim 1, wherein the plunger cartridge housing has a radially outer wall with an exterior surface that is generally cylindrical, and wherein the keeper housing has a mounting bracket portion that permits mounting of the keeper housing to the vehicle door, and a generally hollow-cylindrical cartridge-mounting portion that defines a plunger axis, and that has an inner surface that receives the radially outer wall of the plunger cartridge housing and locks therewith to resist axial forces on the plunger cartridge housing.

3. A kit of parts for a check arm keeper as claimed in claim 2, wherein a cartridge locking projection is positioned on one of the exterior surface of the radially outer wall of the plunger cartridge housing and the inner surface of the cartridge-mounting portion, wherein the cartridge locking projection is engageable with a cartridge locking groove in the other of the exterior surface of the radially outer wall of the plunger cartridge housing and the inner surface of the cartridge-mounting portion, wherein the cartridge locking groove has a first groove portion that extends generally axially and a second groove portion that extends generally circumferentially.

4. A kit of parts for a check arm keeper as claimed in claim 3, wherein a central projection is provided on one of the plunger and the plunger cartridge housing and a projection receiving tube is provided on the other of the plunger and the plunger cartridge housing, wherein the plunger-biasing member is a helical coil compression spring that is positioned in surrounding relationship with the central projection and the projection receiving tube thereby stabilizing the spring during compression.

5. A kit of parts for a check arm keeper as claimed in claim 1, wherein the keeper housing is formed from a contiguous piece of sheet metal.

6. A kit of parts for a check arm keeper as claimed in claim 1, wherein the plunger cartridge housing has an axial end face with a tool engagement feature thereon.

7. A kit of parts for a check arm keeper as claimed in claim 1, wherein the plunger cartridge is a first of two plunger cartridges that are mounted to the keeper housing in facing relationship to one another.

8. A kit of parts for a check arm keeper as claimed in claim 1, wherein the keeper housing has a check arm aperture that permits pass-through of the check arm, and wherein the check arm aperture defines a check arm aperture axis, and wherein at least one fin is provided on one of the plunger and the plunger cartridge housing, wherein the at least one fin extends generally perpendicularly to the check arm aperture axis, wherein the at least one fin is slidably received in at least one guide slot on the other of the plunger and the plunger cartridge housing.

9. A kit of parts for a check arm keeper as claimed in claim 1, wherein the plunger includes a metallic ball that is positioned for engagement with the check arm.

10. A kit of parts for a check arm keeper as claimed in claim 1, wherein the plunger is a metallic ball that is positioned for engagement with the check arm.

11. A method for assembling a check arm keeper for engagement with a check arm to hold a vehicle door in a selected position, comprising:

a) providing a keeper housing having a generally hollow-cylindrical cartridge-mounting portion that defines an axis;

b) providing a plunger cartridge including a plunger cartridge housing that is mountable to the cartridge-mounting portion, a plunger that is slidable in the plunger cartridge housing, and a plunger-biasing member that is positioned in the plunger cartridge housing to urge the plunger out from the plunger cartridge housing;

c) inserting the plunger cartridge axially into the cartridge-mounting portion, wherein during said insertion a projection on one of an exterior surface of the plunger cartridge housing and an inner surface of the cartridge-mounting portion is driven axially in an axially extending portion of a groove in the other of the exterior surface of the plunger cartridge housing and the inner surface of the cartridge-mounting portion, and applying an axially directed force on the plunger cartridge housing that is substantially centered on the plunger-biasing member so as to cause compression of the plunger-biasing member axially; and d) rotating the plunger cartridge housing to drive the projection circumferentially in a circumferentially extending portion of the groove, so as to hold the plunger cartridge housing in a selected axial position relative to the keeper housing, and continuing to apply the axially directed force on the plunger cartridge housing that is substantially centered on the plunger-biasing member so as to maintain compression of the plunger-biasing member.

12. A check arm keeper for engagement with a check arm to hold a vehicle door in a selected position, comprising:

a keeper housing having a generally hollow-cylindrical cartridge-mounting portion that defines an axis;

a plunger cartridge including a plunger cartridge housing that is mountable to the cartridge-mounting portion, a plunger that is slidable in the plunger cartridge housing, and a plunger-biasing member that is positioned in the plunger cartridge housing to urge the plunger out from the plunger cartridge housing; and a locking structure that includes a locking projection on one of an exterior surface of the plunger cartridge housing and an inner surface of the cartridge-mounting portion, and a locking groove in the other of the plunger cartridge housing and the inner surface of the cartridge-mounting portion, wherein the locking groove has a first, axially extending portion and a second, circumferentially extending portion, wherein the plunger cartridge housing has an axial end face with a tool engagement feature for receiving an axial force from a tool, that is generally centered on the plunger-biasing member, and wherein the plunger cartridge is insertable into the cartridge-mounting portion axially to drive the projection along the first portion of the groove, and is rotatable in the cartridge housing to drive the projection along the second portion of the groove while keeping the tool fixed in position in the tool engagement feature so as to maintain the axial force generally centered on the plunger-biasing member.

13. A check arm keeper as claimed in claim 12, wherein the plunger cartridge housing has a radially outer wall with an exterior surface that is generally cylindrical, and wherein the keeper housing has a mounting bracket portion that permits mounting of the keeper housing to the vehicle door, and a generally hollow-cylindrical cartridge-mounting portion that defines an axis, and that has an inner surface that receives the radially outer wall of the plunger cartridge housing and locks therewith to resist axial forces on the plunger cartridge housing.

14. A check arm keeper as claimed in claim 12, wherein a central projection is provided on one of the plunger and the plunger cartridge housing and a projection receiving tube is provided on the other of the plunger and the plunger cartridge housing, wherein the plunger-biasing member is a helical coil compression spring that is positioned in surrounding relationship with the central projection and the projection receiving tube thereby stabilizing the spring during compression.

15. A check arm keeper as claimed in claim 12, wherein the keeper housing is formed from a contiguous piece of sheet metal.

16. A check arm keeper as claimed in claim 12, wherein the plunger cartridge housing has an axial end face with a tool engagement feature thereon.

17. A check arm keeper as claimed in claim 12, wherein the plunger cartridge is a first of two plunger cartridges that are mounted to the keeper housing in facing relationship to one another.

18. A method for assembling a check arm keeper for engagement with a check arm to hold a vehicle door in a selected position, comprising:

a) providing a keeper housing having a generally hollow-cylindrical cartridge-mounting portion that defines an axis;

b) providing a plunger cartridge including a plunger cartridge housing that is mountable to the cartridge-mounting portion, a plunger that is slidable in the plunger cartridge housing, and a plunger-biasing member that is positioned in the plunger cartridge housing to urge the plunger out from the plunger cartridge housing;

c) using a tool to insert the plunger cartridge axially into the cartridge-mounting portion, wherein during said insertion a projection on one of an exterior surface of the plunger cartridge housing and an inner surface of the cartridge-mounting portion is driven axially in an axially extending portion of a groove in the other of the exterior surface of the plunger cartridge housing and the inner surface of the cartridge-mounting portion, and applying an axially directed force on the plunger cartridge housing on the plunger-biasing member so as to cause compression of the plunger-biasing member axially; and d) using the tool to rotate the plunger cartridge housing to drive the projection circumferentially in a circumferentially extending portion of the groove, so as to hold the plunger cartridge housing in a selected axial position relative to the keeper housing, and continuing to apply the axially directed force on the plunger cartridge housing while keeping the tool fixed in position relative to the plunger-biasing member and relative to the plunger cartridge housing.

* * * * *